United States Patent [19]

Crouch et al.

[11] Patent Number: 4,829,714

[45] Date of Patent: May 16, 1989

[54] DEVURRING AND CLEANING MACHINE AND PROCESS

[75] Inventors: Brian E. Crouch, Decorah; Maurice P. Roach, Waterloo, both of Iowa

[73] Assignee: Iowa Engineered Processes, Corp., Independence, Iowa

[21] Appl. No.: 889,430

[22] Filed: Jul. 22, 1986

[51] Int. Cl.[4] ..... A24B 31/00

[52] U.S. Cl. ..... 51/17; 51/163.1; 51/317; 51/319; 51/7

[58] Field of Search ..... 51/7, 424, 2, 16, 17, 51/163.1, 163.2, 317, 319

[56] References Cited

U.S. PATENT DOCUMENTS

| | | | |
|---|---|---|---|
| 1,907,198 | 5/1933 | Hull . | |
| 2,200,724 | 5/1940 | Robins | 51/7 |
| 2,353,492 | 7/1944 | O'Connor | 51/163.1 |
| 2,660,835 | 12/1953 | Burden | 51/7 |
| 2,887,826 | 5/1959 | Schultz . | |
| 3,265,366 | 8/1966 | Warner | 259/56 |
| 3,769,751 | 11/1973 | Perry | 51/2 R |
| 3,793,780 | 2/1974 | Musschoot | 51/14 |
| 4,001,976 | 1/1977 | MacMillan | 51/9 R |
| 4,025,419 | 5/1977 | Musschoot | 51/163.1 |
| 4,160,650 | 7/1979 | Jensen | 51/16 |
| 4,164,103 | 8/1979 | Hesse et al. | 51/417 |
| 4,174,591 | 11/1979 | Dupre et al. | 51/16 |
| 4,218,849 | 8/1980 | Bodine | 51/7 |
| 4,326,362 | 4/1982 | Williams et al. | 51/417 |
| 4,387,537 | 6/1983 | Roach et al. | 51/17 |

*Primary Examiner*—Harold D. Whitehead

*Attorney, Agent, or Firm*—Zarley, McKee, Thomte, Voorhees & Sease

[57] ABSTRACT

A deburring and cleaning maching and process for cleaning and deburring both interior and exterior portions of articles. The process includes mounting the article to be cleaned and deburred in a mounting means and then imparting vibratory movement to an exciter member. A vibration conduction means transfers the vibrations directly to the mounting means. Abrasive media is cascaded over, around, and through the article as it is vibrated within the substantially open space in a framework. The machine utilizes a substantially open framework. A mounting means is positioned within the framework. An exciter member is operatively connected to a vibratory means. A vibration conduction means transfers vibration from the exciter plate directly to the mounting plate. A cascading means is positioned above the fixture to direction abrasive media upon any article to the fixture as it is vibrated.

26 Claims, 1 Drawing Sheet

DEVURRING AND CLEANING MACHINE AND PROCESS

BACKGROUND OF THE INVENTION

A. Field of the Invention

This invention relates to a machine and process for cleaning and deburring articles such as castings, machined parts, and the like, and in particular, to a machine and process for cleaning and deburring work pieces by cascading abrasive material over, around, and through the article.

B. Problems in the Art

Many different methods and apparatuses are used to attempt to deburr and clean manufactured articles such as castings, machined parts, and the like. Problems and disadvantages of conventional methods are set forth in U.S. Pat. No. 4,387,537, which is commonly owned by the owner of the present invention. The disclosure of U.S. Pat. No. 4,387,537, is hereby incorporated by reference. U.S. Pat. No. 4,387,537 took the novel approach of mounting the article to be cleaned and deburred to fixtures or mounting plates within a substantially open framework. The fixtures holding the articles were vibrated while abrasive media was cascaded over, around, and through the articles by reciprocating the fixtures in a predetermined pattern within the open treating area within the framework. This was accomplished by mechanically linking the fixtures to a power means which produced the reciprocating movement.

Because the articles are held in a substantially open area, and because the abrasive media is allowed to contact and be vibrated through and around the articles, advantageous cleaning and deburring results have been achieved. However, still further improvements are desirable. The mechanical linkage required in U.S. Pat. 4,387,537 is subject to some maintenance and expense concerns. The power required to operate this system could ideally be advantageously decreased.

It is therefore a primary object of the present invention to provide a deburring and cleaning machine and process which improves over and solves the problems and deficiencies in the art.

A further object of the present invention is to provide a deburring and cleaning machine and process which allows cleaning and deburring media to pass over, around, and through the article being cleaned and deburred.

A further object of the invention is to provide a deburring and cleaning machine and process which vibrates the article being cleaned and deburred while secured to a fixture beneath cascading cleaning and deburring media.

Another object of the invention is to provide a deburring and cleaning machine and process which minimizes mechanical parts and power consumption.

A still further object of the invention is to provide a deburring and cleaning machine and process which is economical, durable, and efficient.

These and other objects, features, and advantages of the invention will become more apparent with reference to the accompanying specification and claims.

SUMMARY OF THE INVENTION

The method of the present invention involves mounting an article to be cleaned and deburred in a fixture or a mounting means within a substantially open framework. Vibratory movement is imparted to the fixture and article. The article is held directly beneath cascading abrasive media which passes over, around, and through the article. The abrasive media is then collected below the workpiece and transported for reuse to the cascading mechanism.

The machine of the invention utilizes a mounting plate for securing the article positioned with a substantially open portion of the framework. Vibratory means within the framework sets up vibratory movement in an exciter member which is transmitted directly to both the mounting plate and the article being cleaned and deburred through a vibration conduction means. The preferred embodiment utilizes at least one rotating wheel means, the wheel means being in some way imbalanced to produce the vibratory motion.

The mounting plate, the vibration conduction means, exciter member, and vibratory means can be isolated from the framework by shock absorbing means. The mounting plate itself can be independently isolated from the framework. The vibration conduction means can include mechanical vibration amplifying means to amplify vibrations to the fixture. Additionally, a container member can be added to the mounting plate surrounding the article to assist in controlling the direction and rate of flow of abrasive media and to enhance the cleaning and deburring action.

A media return system utilizing a collection area, a horizontal conveyor and a vertical elevator, can be used to return abrasive media to the cascading means.

DETAILED DESCRIPTION OF THE PREFERRED EMBODIMENT

Figure 1:
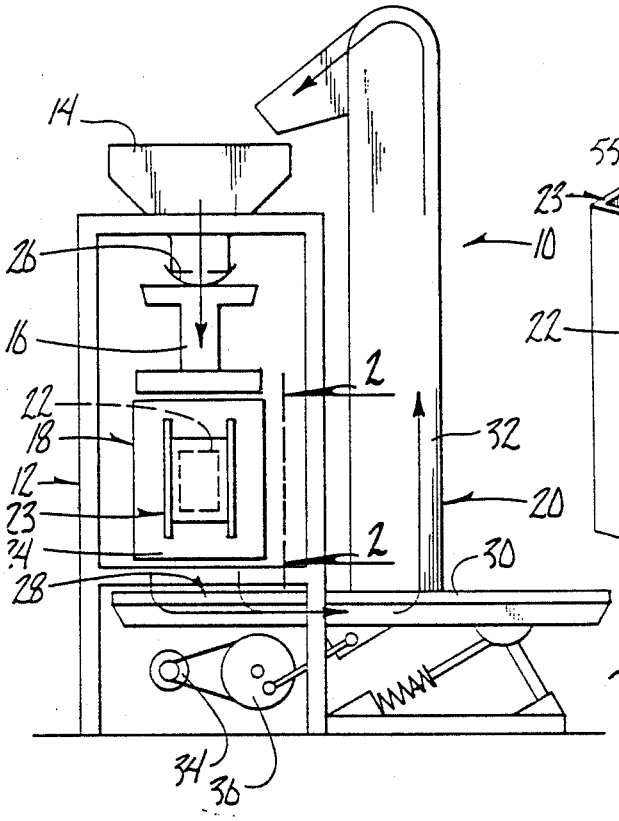
FIG. 1 is a elevational schematic view of the invention.

With reference to the drawings, and particularly FIG. 1, there is shown a deburring and cleaning machine 10 according to the invention. A substantially open framework 12 supports an abrasive media hopper 14, a media distributor apparatus 16, a vibratory drive unit 18, and a media return system 20.

An article 22 (also known as a work piece or part) to be cleaned and deburred is secured to a fixture 23 mounted on mounting plate 24 which is associated with vibratory drive unit 18.

As can be seen in FIG. 1, article 22 in fixture 23 is vibrated underneath media distributor apparatus 16. Media flow control door 26 is operated to release abrasive media downwardly through media distributor apparatus 16 which distributes the media over, around, and through article 22, as it vibrates while secured to mounting plate 24. The free-falling abrasive media is able to contact, clean, and deburr portions of the article, both exteriorly and interiorly, and then fall into media return system 20.

Media return system 20 is comprised of a collection area 28, a horizontal conveyor 30, and a vertical elevator 32. Conveyor 30 and elevator 32 can be of a variety of configurations, all as is known and well within the skill of those of ordinary skill in the art. A conventional motor 34 and belt driven pulley 36 could be used to power the conveyor 30 and elevator 32. Other alternative means well within the skill of those of ordinary skill in the art can also be used. Media return system 20 collects and transports the media back to hopper 14 for reuse. Fixture 23 and mounting plate 24 are configured so that articles 22 can be easily and quickly secured and removed.

Figure 2:
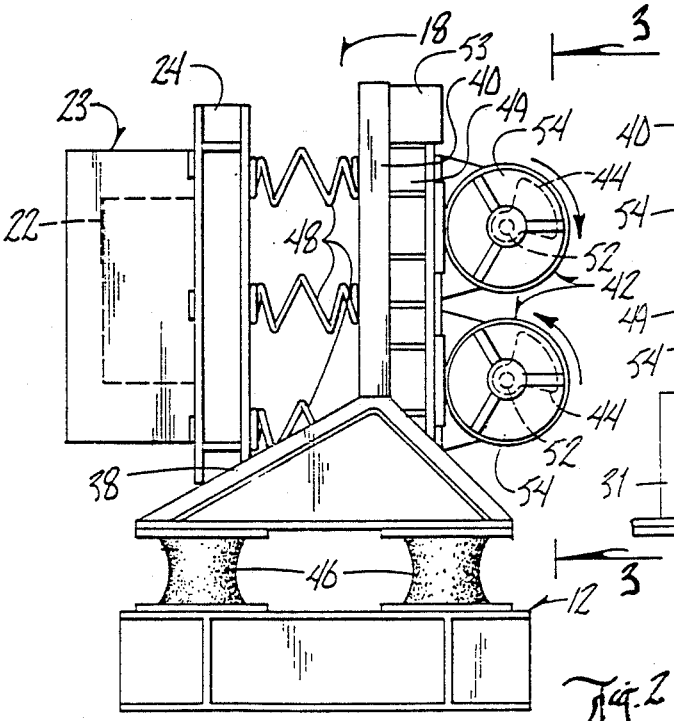
FIG. 2 is an isolated elevational view taken along lines 2—2 of FIG. 1.

FIG. 2 depicts in isolation the vibratory drive unit 18 of the invention with mounting plate 24, fixture 23, and an article 22 connected to it. Mounting plate 24 is attached to vibration conductor members, which in this embodiment are reaction springs 48. An exciter plate 40 is attached to the other ends of reaction springs 48 at a substantially parallel, spaced-apart position from mounting plate 24. Exciter plate 40 is integrally connected to a base member 38 which is mounted to framework 12 by shock absorbers or isolation pads or springs 46. Mounting plate 24 is not attached to base member 38 and is connected to exciter plate 40 only by reaction springs 48. Vibratory motion is transmitted to mounting plate 24 with attached fixture 23 and article 22 by rotation of weights 44 of imbalanced vibration mechanisms 42. Weights 44 (shown by ghost lines in FIG. 2) are eccentrically mounted or unbalanced on axles 52 and produce vibration in exciter plate 40 which is transmitted through vibration reaction springs 48 to mounting plate 24. A counter-weight 53 at the top of exciter plate 40 counter-balances the mass of base member 38 to produce desirable, controlled vibration by the entire exciter plate 40. In the preferred embodiment exciter plate vibrate approximately one-sixteenth of an inch. Reaction springs 48 then amplify this vibration of exciter plate 40 to mounting plate 24.

Isolation springs 46 can be made of rubber or other suitable material and serve to confine vibratory movement to vibratory drive unit 18, mounting plate 24, fixture 23, and article 22.

Figure 3:
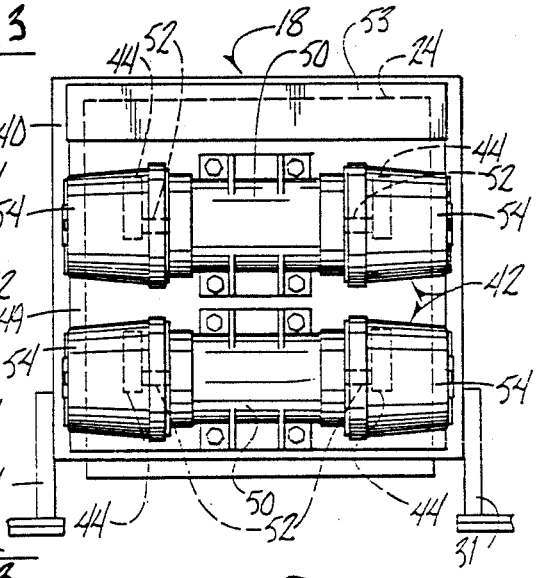
FIG. 3 is an isolated elevational view taken along lines 3—3 of FIG. 2

FIG. 3 depicts the preferred configuration for imbalanced vibration mechanisms 42. Two rotary motor mechanisms 50, one above the other, are mounted to motor mounts 49 which in turn are directly mounted to exciter plate 40. Each rotary motor 50 has an axle 52 extending from its opposite ends horizontally. Imbalanced weights 44, each enclosed by weight covers 54, are secured to each axle end. The upper pair of weights 44 is preferred to be revolved oppositely to the lower pair of weights 44, or each pair could be rotated in the same direction. It is pointed out that the rotational axes of weights 44 are transverse to the article being vibrated. This has been found to be the best orientation to produce vibratory movement. It is to be understood, however, that different configurations for imbalanced vibration mechanisms 42 are possible, from a single weight 44, to two, three, four, or more weights 44 in various configurations. It is also to be understood that other methods of producing vibratory movement in exciter plate 40 are possible. Wheels eccentrically offset or imbalanced on axles 52 could be rotated to produce such vibratory motion.

It should also be understood that imbalanced vibration mechanisms 42 and exciter plate 40 might be directly joined to mounting plate 24, with mounting plate 24 performing the function of both a mounting fixture for article 22 and a vibration conduction member.

For a description of an embodiment of imbalanced wheel mechanisms 42 which would function in the present invention, reference can be taken of U.S. Pat. No. 3,793,780. Imbalanced wheel mechanism 42 can be purchased from the owner of U.S. Pat. No. 3,793,780, General Kinematics of Barrington, Ill.

In operation, an article 22 is secured in fixture 23 to mounting plate 24 by means known or readily adaptable in the art. Rotary motor mechanisms 50 are operated to rotate weights 44. The imbalance of weights 44 impart vibratory movement to exciter plate 40 which is transmitted to mounting plate 24 through vibration conduction members or reaction springs 48. Media flow door 26 is opened to allow abrasive media to fall into media distributor apparatus 16 to be distributed onto, around, and into the vibrating article 22. As explained in U.S. Pat. No. 4,387,537, the present invention allows improved cleaning and deburring of interior and exterior portions of the article.

Return and recirculation of the abrasive media is facilitated by its collection in collection area 28, and subsequent transport by horizontal conveyor 30 and vertical elevator 32 back into media collection hopper 14.

It is to be understood and appreciated that the present invention an take many forms and embodiments. The true essence and spirit of this invention are defined in the appended claims, and it is not intended that the embodiment of the invention presented herein should limit the scope hereof.

Figure 4:
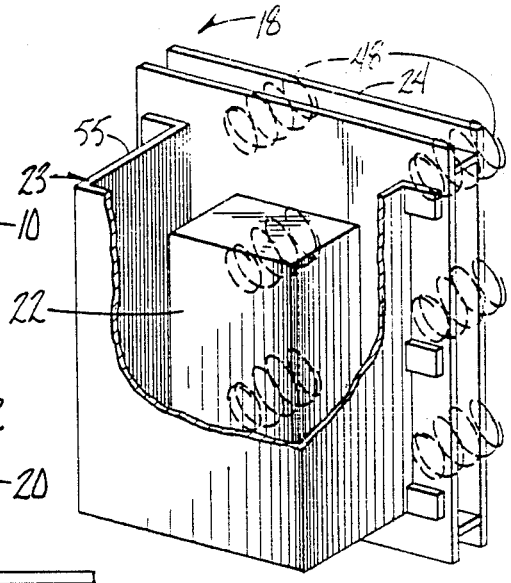
FIG. 4 is an isolated perspective view of the mounting plate with an article attached and including a container member around the article.

For example, as shown in FIG. 4, a fixture 23 could take the form of a container member 55 which could be secured to mounting plate 24 surrounding at least portions of article 22. While still allowing free-falling media to be imparted on article 22 and exit to media return system 20, container member 55 could be configured to enhance cleaning and deburring in certain situations. Container member 55 could by designed configuration control direction of flow of media to and into article 22. It could also control rate of flow of media. It might also increase residence time of media at portions of article 22. It is to also be understood that container member 55 could be part of fixture 33 or mounting plate 24. Also, container member 55 or fixture 23 might be made to be permanent or removable pieces of mounting plate 24 to help secure article 22 to it, but also control direction and flow of media. Baffles could be inserted inside container member 55 to further direct flow of media.

It can therefore be seen that the invention achieves at least all of is stated objectives, in particular an improved open framework machine with a vibratory means which avoids cranks and mechanical limbs, and which operates at reduced power.

We claim:

1. A means for cleaning and deburring articles comprising: a substantially open framework;

mounting means positioned within a substantially freely open portion of said framework to which one or more articles to be cleaned an deburred can be rigidly but removably secured said mounting means being aligned so that any secured article would be in the path of free-falling cascading abrasive materials within the framework and allow the cascading abrasive materials to free-fall around, past and out of any secured article and then be collected for further use;

an exciter member associated with the framework and the mounting means, the exciter member comprising a base member connected to but isolated from the framework by shock absorbing means, and an excitation plate extending from the base member, said excitation plate having first and second sides;

vibratory means secured to the first side of the excitation plate of the exciter member;

vibration conduction means attached between the second side of the excitation plate of the exciter member and the mounting means in the framework for direct transmission of vibratory movement to the mounting means from the excitation plate of the exciter member and vibration conduction means, said conduction means causing any secured article on said mounting means to vibrationally move within the path of the free-falling cascading abrasive media; and cascading means positioned on the framework above the mounting means to cascade the free-falling abrasive media within the framework and over, around, and through exterior and interior portions of any article mounted on the mounting means.

2. The means of claim 1 further comprising a container means surrounding at least a portion of the article secured to the mounting means when media is cascaded over the article to selectively control direction and rate of flow of media to the article.

3. The means of claim 1 wherein the mounting means comprises a fixture having grasping means for securing at least one article to the fixture.

4. The means of claim 1 wherein the vibratory means comprises at least eccentrically weighted means rotatably driven by a power means.

5. The means of claim 4 wherein the eccentrically weighted means is eccentrically centered about an axle driven by the power means.

6. The means of claim 4 wherein the eccentrically weighted means is imbalanced.

7. The means of claim 4 wherein the rotational axis of the eccentrically weighted means is transverse to the article being cleaned and deburred.

8. The means of claim 4 wherein the eccentrically weighted means comprises two weights each being operatively connected to a power means and each turning in opposite rotational directions.

9. The means of claim 4 wherein the eccentrically weighted means comprises first and second sets of weights, each set being driven by a power means and turning in an opposite direction from the other set.

10. The means of claim 1 wherein the vibratory means and exciter member are isolated from the framework by shock absorbing isolation springs.

11. The means of claim 1 wherein the vibration conduction means comprise mechanical vibratory amplifying means operatively connected between the exciter member and the mounting means for amplifying vibratory movement to the mounting means and article being cleaned and deburred.

12. The means of claim 1 wherein the vibration conduction means comprise reaction springs.

13. The means of claim 1 further comprising means for collecting and transporting abrasive media from beneath the article being cleaned and deburred to return the abrasive media to the cascading means for reuse.

14. The means of claim 1 wherein the vibration conduction means produces vibratory movement which vibrationally moves any article secured to the mounting means generally in directions transverse to the direction of fall of the abrasive media.

15. The means of claim 1 wherein the excitation plate extends substantially vertically from the base of the exciter member, and said vibration conduction means extend from the excitation plate substantially horizontally to the mounting means.

16. The means of claim 1 wherein the vibratory means comprise a plurality of motor means each rotating one or more flywheels, said flywheels being eccentrically weighted.

17. The means of claim 16 wherein the flywheels of the motor means have rotational axes which are generally parallel to the general plane of the exciter plate.

18. A method for cleaning and deburring an article comprising the steps of:

removably but rigidly mounting at least one article to be cleaned and deburred to a mounting means positioned within a substantially open portion of a substantially open framework, said mounting means being aligned so that any secured article would be in the path of free-falling cascading abrasive media within the framework and allow the cascading abrasive materials to free-fall around, past and out of any secured article and then be collected for further use;

producing vibratory movement in an excitation plate in an exciter member, the exiter member comprising a base member connected to but isolated from the framework by shock absorbing means, the excitation plate extending from the base member and having a first side to which is attached vibratory means for creating a vibratory force, and having a second side;

transmitting vibratory movement from the vibratory means and excitation plate directly to the mounting means and article through a vibration conduction means connected to the second side of the excitation plate causing any secured article on said mounting means to vibrationally move within the path of the free-falling cascading abrasive media; and cascading free-falling abrasive materials over, around, and through the exterior and interior portions of the article within the framework.

19. The method of claim 18 wherein the vibratory movement is produced by one or more imbalanced rotating eccentric weighted means.

20. The method of claim 19 wherein vibratory movement is produced by two imbalanced eccentric weighted means rotating in opposite directions.

21. The method of claim 19 wherein each rotating eccentric weighted means is oriented towards the article being cleaned and deburred.

22. The method of claim 18 further comprising mechanically amplifying the vibratory movement imparted to the article.

23. The method of claim 18 further comprising isolating by shock absorbing means the vibratory means and exciter member from the framework.

24. The method of claim 18 wherein the vibration conduction means produces vibratory movement which vibrationally moves any article secured to the mounting means generally in directions transverse to the direction of fall of the abrasive media.

25. A cascading deburring machine comprising:

a substantially open framework;

a vibratory means comprising one or more imbalanced wheels rotatably driven by a power means and operatively associated with the framework to cause vibratory movement;

an exciter member comprising a base member connected to but isolated from the framework by shock absorbing means, and an excitation plate extending from the base member, said excitation plate having first and second sides;

a workpeice mounting means responsively connected to the excitation plate of the exciter member for responsive vibratory movement of the mounting means within the framework but in a freely open portion of the framework in response to vibratory force created by the vibratory means, and said mounting means being aligned so that any secured article would be in the path of free-falling cascading abrasive media within the framework said vibratory means causing any secured article on said mounting means to vibrationally move within the path of the free-falling cascading abrasive media; and cascading means positioned on the framework above the mounting means to cascade free-falling abrasive media within the framework and over, around, and through interior portions of any article to be cleaned which might be mounted to the mounting means.

26. The machine of claim 26 wherein the vibratory means produces vibratory movement which vibrationally moves any article secured to the mounting means generally in directions transverse to the direction of fall of the abrasive media.

* * * * *